United States Patent [19]

Naumann

[11] 4,001,998

[45] Jan. 11, 1977

[54] PRE-FABRICATED STRUCTURAL ELEMENTS AND METHOD OF ASSEMBLING THE SAME

[75] Inventor: Wolfgang Naumann, Cologne, Germany

[73] Assignee: Horst W. Pollehn, Freidburg-Zaehringen, Germany

[22] Filed: Dec. 1, 1975

[21] Appl. No.: 636,365

[30] Foreign Application Priority Data

Dec. 12, 1974 Germany ..... 2458750

[52] U.S. Cl. ..... 52/608

[51] Int. Cl.[2] ..... E04B 5/00; E04C 1/00

[58] Field of Search ..... 52/604, 608, 609, 234, 52/236, 79, 741, 747, 578, 596, 605

[56] References Cited

UNITED STATES PATENTS

| | | | |
|---|---|---|---|
| 1,664,606 | 4/1928 | Fischer | 52/604 X |
| 2,739,118 | 3/1956 | Cary | 52/608 X |
| 2,942,115 | 6/1960 | O'Connell | 52/604 X |

*Primary Examiner*—J. Karl Bell

*Attorney, Agent, or Firm*—Saul Jecies

[57] ABSTRACT

Each pre-fabricated element of the invention has an abutment face which, in the assembled condition, is to be juxtaposed with the similar abutment face of another element so as to define a gap therewith which may be filled with a sealant or a bonding agent. The abutment faces are so shaped that longitudinal sections of the gap are spatially curved and define at least partly orthogonal trajecteries of the main structural stress lines acting in the region of the gap.

11 Claims, 29 Drawing Figures

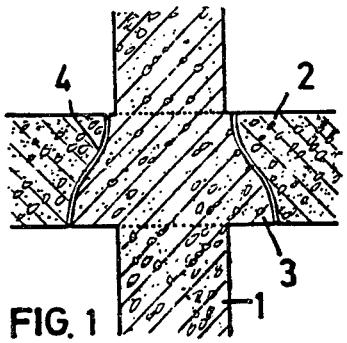
FIG. 1
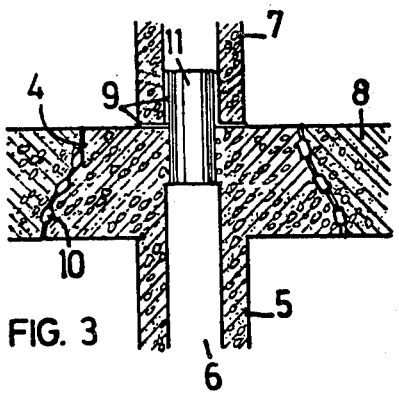
FIG. 3
FIG. 2
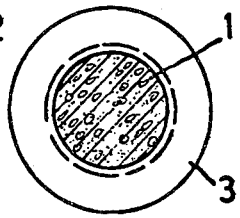
FIG. 4
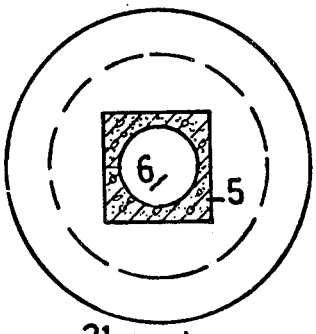
FIG. 5
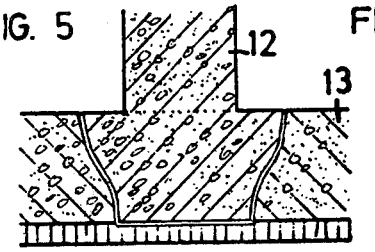
FIG. 8
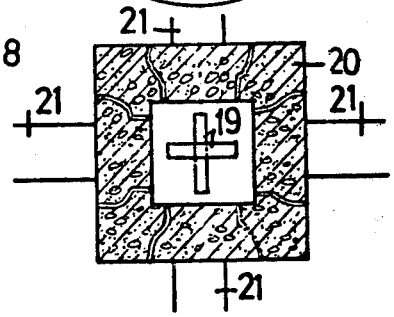
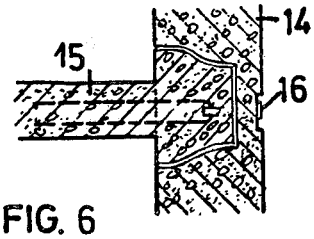
FIG. 6
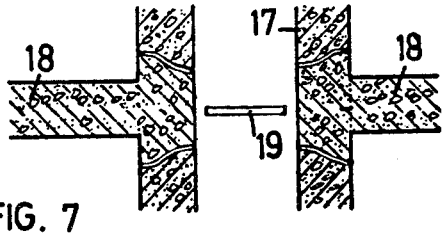
FIG. 7

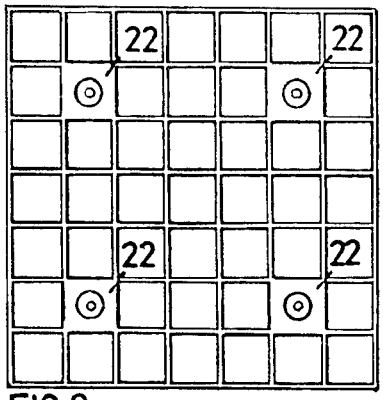
FIG. 9
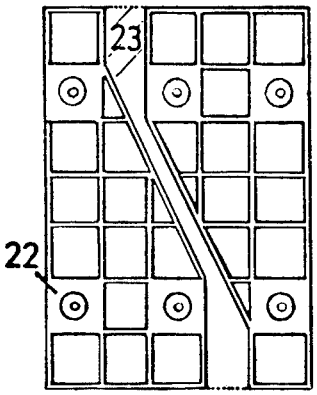
FIG. 10
FIG. 11
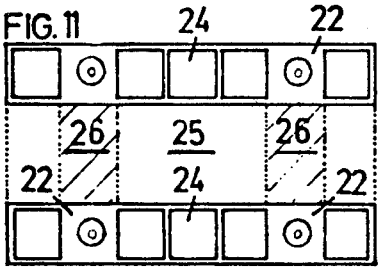
FIG. 17
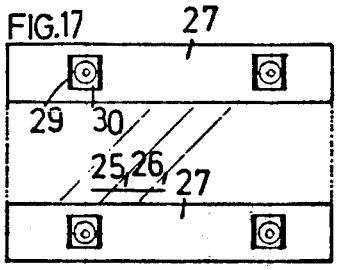
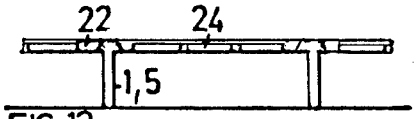
FIG. 12
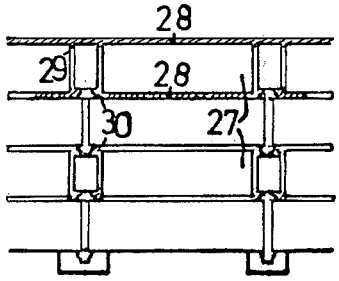
FIG. 18
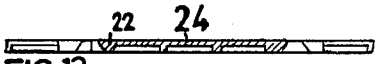
FIG. 13
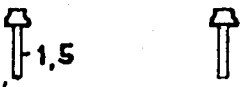
FIG. 14
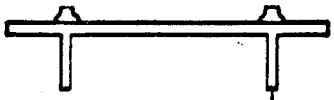
FIG. 15
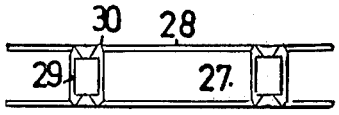
FIG. 19
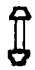
FIG. 20
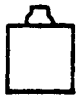
FIG. 16

PRE-FABRICATED STRUCTURAL ELEMENTS AND METHOD OF ASSEMBLING THE SAME

BACKGROUND OF THE INVENTION

The present invention relates to pre-fabricated structural elements and to a method of assembling the same.

Such elements may, but need not be, reinforced concrete elements, such as pre-fabricated reinforced concrete members.

Structural combinations or assembly sets for erecting of such structures as buildings or the like, have been proposed in the art, e.g. from German Published Applicaion No. 1,484,043, German Gebrauchsmuster No. 7,313,393 and British Patent No. 1,601,783. These disclosures are all directed to the problem of attaining stiff, bending-resistant joint in structural assemblies made by connecting pre-fabricated structural elements together. They prepare point-supporting of the elements on frusto-conical abutments. However, experience has shown that these proposals are not advantageous because the magnitude of clamping forces (i.e. retentive forces which prevent relative shifting of the elements) which can be attained in this manner is very low.

The moment acting at the juncture of such prefabricated elements resolves itself into a horizontally acting couple of forces; the direction in which these forces act relative to the juncture or joint (an inclined wedge-shaped plane) produces a force acting parallel to the joint and tending to move the elements apart from one another. This latter force can be absorbed only partially by the frictional resistance which the elements oppose to it in the region of the joint. This factor determines the limits of the degree of efficiency of this prior-art form of support because the magnitude of the frictional resistance required to obtain a state of equilibrium (i.e. for the frictional force to completely absorb the separating force) cannot be ascertained with general validity for the erection of structures.

Accordingly, a form of support must be considered to be statically favorable, wherein the frictional forces in the joint between cooperating structural elements need not be relied upon, but can instead be utilized merely as a secondary way of increasing the carrying capacity of the joint so as to enhance the structural safety.

Another disadvantage of the type of support suggested in the prior art for the structural elements is caused by a horizontally acting separating force which is generated by the vertical load. Depending upon the magnitude of the wedge angle of the support, this force may amount to a multiple of the vertical load. The order of magnitude of this separating force decisively affects the structural and economic factors involved in erecting structures of the type under discussion, as it plays a part in determining the helical reinforcement surrounding a socket, or the strength of the mantle required in a pin-and-socket joint, or the magnitude of the horizontal shear stress.

The prior-art attempts to make a pre-fabricated reinforced-concrete construction method more economical and/or technologically more advantageous by making the support or joint conditions approach those which are known from monolithic concrete-skeleton structures, are well known in the field and need not be discussed here.

SUMMARY OF THE INVENTION

It is an object of the present invention to overcome the difficulties of the prior art.

More especially, it is an object of the invention to provide a novel set of structural assembly elements which is not possessed of these difficulties.

A further object of the invention is to provide a novel method of erecting a structure from pre-fabricated structural components.

Pursuant to these and other objects which will be perceived from a perusal of the following description, one aspect of the invention resides in a set of structural assembly elements which comprises a first and second element having respective abutment faces and being adapted to be so assembled relative to one another that the abutment faces bound with one another an elongated gap. The abutment faces are so shaped that longitudinal sections of the gap which they bound are spatially curved and also define at least partly orthogonal trajectories of the main structural stress lines acting in the region of the gap.

Thus, the invention provides a set of assembly elements in which the cooperating elements form with one another — due to the shape of their abutment faces and the joint gap which these faces bound and define with one another — a simple, detachable, push-pull resistant joint which has great bending resistance.

The solution found in accordance with the present invention is based on the recognition that a curved abutment face can be formed in shape and position that gradient corresponds at any point to one of the two principal stress directions which act at right angles to one another. Using thusly shaped surfaces to bound the joint gap between structural elements results in a statically highly favorable form of support, and in a stiff joint which is resistant to bending. Depending upon the purpose of the joint and its static loading, the spatially curved surface may be formed at the bottom end, the top end or the sides of a structural element serving as a support or buttress.

The invention will hereafter be described in more detail with reference to the several exemplary embodiments which are shown in the drawing.

BRIEF DESCRIPTION OF THE DRAWING

FIG. 1 is a longitudinal section through a joint between structural elements employing the invention;

FIG. 2 is a cross-section through one of the elements in FIG. 1;

FIG. 3 is a view similar to FIG. 1, but showing a different embodiment;

FIG. 4 is a cross-section through elements of the embodiment in FIG. 3;

FIG. 5 is a view similar to FIG. 1, but of another embodiment;

FIG. 6 is a view similar to FIG. 5, showing a further embodiment of the invention;

FIG. 7 is another longitudinal section, showing an additional embodiment of the invention;

FIG. 8 is a horizontal section through a further embodiment and

FIGS. 9–29 are all detail views, partly in section, illustrating connections between structural elements according to the present invention.

DESCRIPTION OF THE PREFERRED EMBODIMENTS

Figure 21:
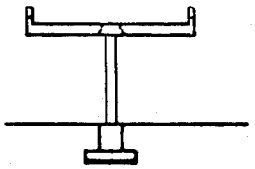

Discussing the drawing in detail, reference will first be had to the embodiment illustrated in FIGS. 1 and 2.

FIG. 1 shows a longitudinal section of a joint or cross-over point of two structural elements 1 and 2, wherein an abutment portion 3 is formed on the structural element 1. The gap formed between the juxtaposed abutment faces of elements 1 and 2 is identified with reference numeral 4. The structural element 1 may be oriented horizontally, vertically or even obliquely and the structural element 2 will then, of course, be arranged accordingly. The structural element 1 may act statically as a compression—or tension—element.

The structural element 2 may e.g. be oriented horizontally, and may form e.g. a ceiling- or floor-element; alternatively it may be oriented vertically and e.g. form a wall element of a silo or other structure, or a wall element loaded by soil pressure.

The gap 4 between the juxtaposed abutment faces of the cooperating structural elements 1 and 2 may be left dry and/or be equipped with a prefabricated gap-sealing element (not shown), e.g. of NEOPRENE (registered trade mark) or it may be filled with a mortar or other bonding agent. If the gap is left dry and no sealing element is used, then the juxtaposed abutment faces of the elements 1 and 2 will be in surface-to-surface contact; in such a case the word "gap" should be understood to be merely generally descriptive, as there will actually be none (or hardly any) clearance.

FIG. 2 shows a cross section of the structural element 1 of FIG. 1 as well as the shape of the support- or buttress-abutment portion 3 thereof in a view from below. The cross-sectional shape of the element 2 to be supported may be e.g. round or square.

FIG. 3 shows a longitudinal section of a joint resistant to tension and compression and also stiff in bending which e.g. is formed by prefabricated reinforced-concrete structural elements of a multi-story building. The support elements 5 and 7, which are e.g. vertically orientated, are abutting storywise, i.e. vertically; their cavities 6 in the central region may serve, depending on their size, as a vertical supply shaft or to accommodate electrical and/or water and sewage sources. The horizontally oriented ceiling element 8 may be constructed as an area support structure or as an articulated underslung beam structure. The support element 7 is pivotally supported at the level of the upper edge of the support element 5. Prevention of shifting in a horizontal direction is assured by e.g. a steel pipe 11 which is firmly anchored in the support element 5 and has indirect contact with the support element 7 via a material that is cast into the gap 9 defined between pipe 11 and element 7.

Optionally, the two elements 5 and 8 to be joined may be provided with mutually opposite recesses in the region of the gap 4; after the casting of mortar into the gap 4 the presence of such recesses into which the mortar enters increases the strength of the gap for special cases.

FIG. 4 shows a horizontal section of the structural element 5 of FIG. 3 in a view from below.

FIG. 5 shows e.g. a longitudinal section of a stiff jont resistant to bending that is formed between a support element 12 and an on-site concrete foundation plate 13.

FIG. 6 shows e.g. a vertical section of on-site concrete wall 14 and of a horizontal cantilever beam 15 whose lack of supporting force in direction normal to the wall is substituted by a mechanical joint 16, e.g. a bolt connection.

FIG. 7 shows e.g. a vertical section of a shaft-like structural element 17 to which two horizontally opposed structural components 18 are clamped in a manner to form a stiff joint resistant to bending. The supporting force in direction normal to the element 17 which may be lacking in these components, is replaced by a diagrammatically shown mechanical joint 19, e.g. a turnbuckle.

FIG. 8 shows e.g. a horizontal section of a structural unit in the form of a cube-shaped cell 20. The structural elements 21, which are horizontally oriented and are angularly offset by 90° relative to each other, form in this cell a stiff joint resistant to bending. The supporting forces acting in the normal direction which may be lacking in such units, are replaced by mechanical joints 19. When placing the cube-shaped cell 20 e.g. into the center point of a spatial skeleton support system, almost unlimited varieties of single-story or multi-story support structures in skeleton shape may be formed. A cube-shaped cell at the center point of a system formed for example a stiff joint resistance to bending as regards the six Cartesian co-ordinates of space.

A further alternative is formed e.g. by a system center point cell in spherical shape. Depending on the choice of material or element filling the respective gap 4, all the aforesaid joints are so constructed that they may be dismantled in the simplest manner.

FIG. 9 shows a plan view from below of a ceiling unit which is prefabricated locally on the site, e.g. as a reinforced concrete ceiling or a shallow-rib ceiling in a bay construction method, and directly after being mounted on four support elements it forms a carrying structure that is spatially stiff and resistant to bending. The support conditions required therefor have been described with reference to, and illustrated in, FIGS. 1 and 3.

In the socket regions 22 the ribbed articulated ceiling unit is of solid cross-section. Technological and economic advantages are attained owing to low structural height, simple connections, the throughput effect of cantilever beam constructions as well as to the indirect support connection between ceiling and support elements.

FIG. 10 shows, analogous to FIG. 9, a ceiling unit with three-point support. The intermediate structural components 23 may be made in the conventional way.

FIG. 11 shows a plan view from below of two ceiling element units 24 with two-point support, which in the region of the joints 22 are of solid cross-section (see FIGS. 28, 29).

The ceiling units 24 serve at the same time as supports for the conventional intermediate components 25 and 26 which are connected to the ceiling units 24 wholly or partly stiff in bending resistance.

FIG. 12 shows a vertical section of FIG. 11. The designation of the supports with reference 1, 5 is intended to indicate that the same may be made at will either in form of the solid elements 1 in accordance with FIG. 1 or in form of the hollow elements 5 in accordance with FIG. 3.

FIG. 13 shows a vertical section of the aforesaid ceiling unit 24 and is self-explanatory.

FIG. 14 shows the support elements 1, 5 in individual elevation to indicate that they may find application at will e.g. in the embodiments of FIGS. 9 to 12.

FIG. 15 shows by way of example a different, namely a yoke-shaped support element 150.

FIG. 16 shows by way of another example a plate-shaped support element 160.

Figure 28:
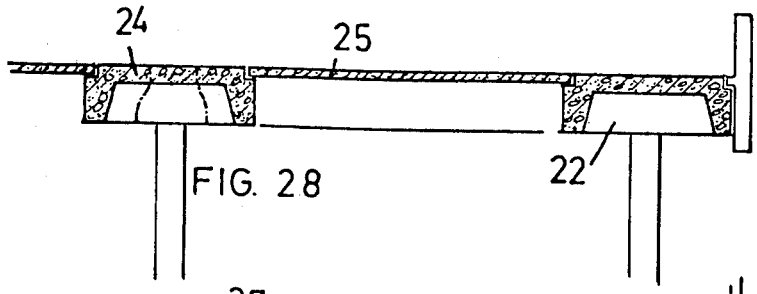
Figure 29:
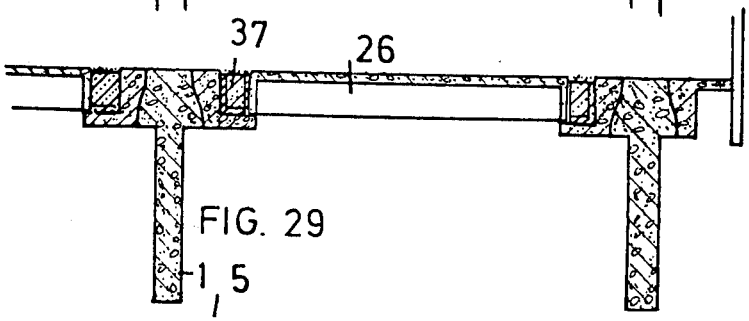

FIGS. 17, 18 and 19 show e.g. a view of two cell-like story units 27 (compare FIGS. 28, 29). This cell system which is applicable e.g. to the construction of dwellings, comprises comparatively thin-walled floors and ceilings (compare part 28 of FIG. 18).

Between the bulkhead-like support- and wall-elements 29, which connect the floor- and ceiling-plates 28, a floor- or ceiling-re-inforcement 30 is arranged wherein the associated recess is provided. Thus, even with thin-walled floor- or ceiling-elements 28 a connection to a corresponding support element is formed stiff in bending. The story units 27 may serve at the same time as supports for conventional intermediate structural components 25 and 26 which are connected to the story units 27 wholly or partly stiff in bending (compare also FIGS. 28, 29).

FIG. 20 shows an individual representation of a support element 200 as used in the intermediate storys of FIGS. 17 and 18.

FIG. 21 shows e.g. a vertical section of a roof structure with a one-point support, wherein the joint of the support element and the roof structure has the conditions according to the invention. At its foot the support element is held in a conventional manner by the subsequent casting of concrete into a socket of the foundation.

Alternatively, the structure of this Figure is also applicable to a support for an elevated road way.

Figure 22:
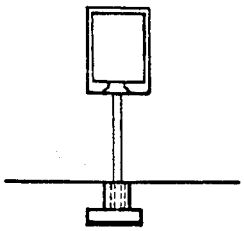
Figure 23:
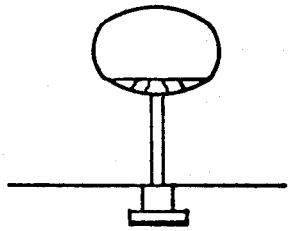

FIG. 22 and FIG. 23 show e.g., analogous to FIG. 21, one-point supports for tunnel-like supply- or communication- structures.

Figure 24:
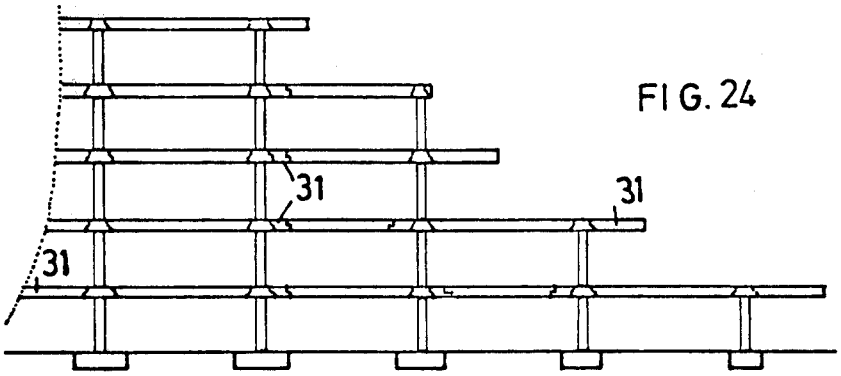

FIG. 24 shows e.g. a terraced multi-story skeleton building in sectional elevation from which the advantages of the simple, but effective joints stiff in bending can be appreciated: with the support of the ceiling unit as a carrier body structure resting according to the invention on the support elements, a structure free from underslung beams is formed which permits a variable cantilever construction 31 to be made. Thereby a progressive and economic throughput effect on the ceiling unit is established, and at the same time artistic shaping of the building facade is made possible (note the broken line). The usual objections to uniform, barrack-like assemblies can thus be met with simple means.

Figure 25:
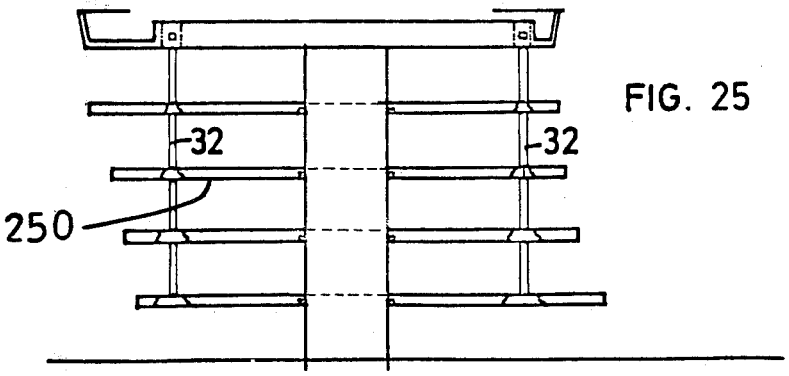

FIG. 25 shoes e.g. in sectional elevation a multi-story building the center portion of which is erected in a conventional manner. On this center portion the support elements 32 are mounted; the latter form with the ceiling units 250 of each story a connection according to the invention, and thus stabilize the structure even while the same is still in a state of assembly. If the support elements 32 are found as hollow bodies, the supply ducts for services to the individual storys can be accommodated therein. Particularly if the building plan is intended to be variable to permit later changes, the possibility of making subsequent insertion of, or changes to, the services (electrical, water, sewage, gas, etc.) is of decisive importance.

Figure 26:
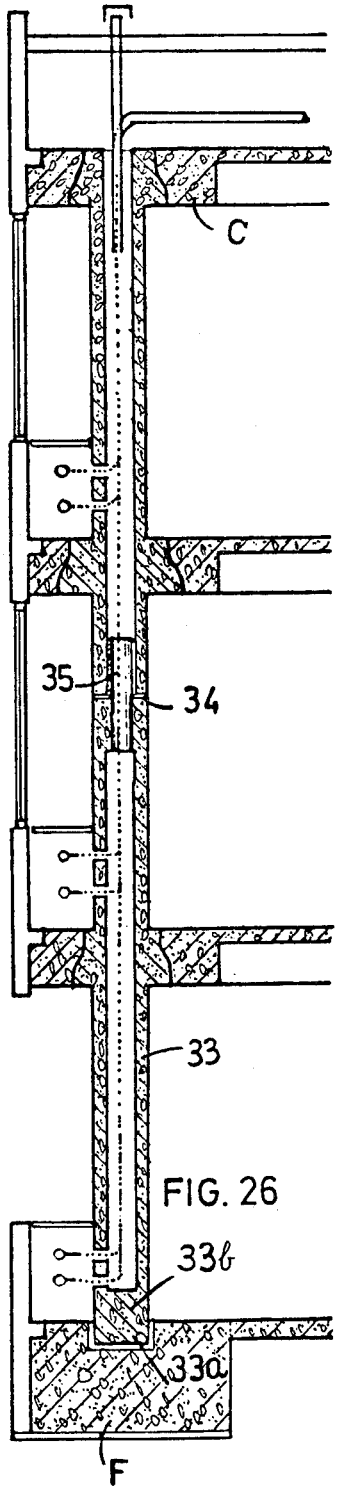

FIG. 26 shows a sectional elevation on the axis of a support unit which is constructed as a supply shaft. The support 33 rests pivotally with its foot 33*a* on the foundation, but it is restrained vertically and horizontally. In order to increase the carrying capacity in the non-reinforced gap in the region included with the foundation F, the cross-sectional area of the lower part 33*b* of the supporting element 33 is not made hollow, but solid.

In order to improve the spatial stiffness of the building, a support joint 34 is provided in the upper third of the second story. Horizontal restraint is obtained by insertion of a steel tube 35. The installation of services in the hollow interior of support 33 can be made (and varied) for the individual story from the region intermediate the roof and the uppermost ceiling C.

Figure 27:
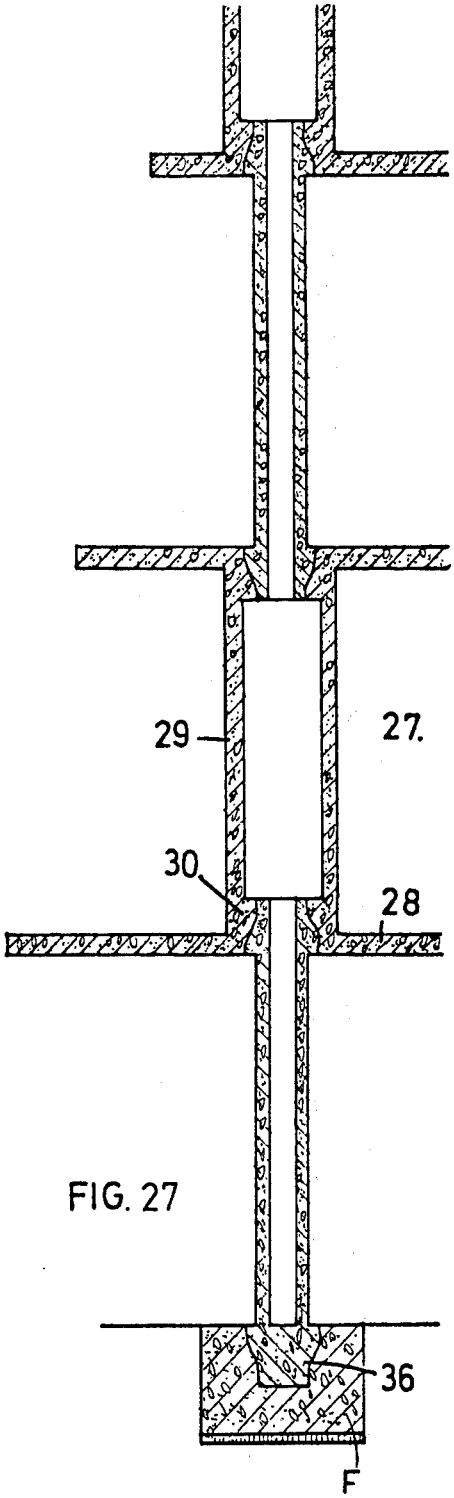

FIG. 27 shows a sectional elevation on the support axis of a multi-story building in accordance with principles described relative to FIGS. 17, 18, 19 and 20. Like reference numerals identify the elements. The connection of the support element at 36 to the foundation F shows the conditions according to the invention for establishing a joint stiff in bending.

FIG. 28 shows a vertical section of the system illustrated in FIGS. 11 and 12 in the region of the intermediate structural components 25.

FIG. 29, finally, shows a vertical section of the system illustrated in FIGS. 11 and 12 in the intermediate range 26, comprising connections by conventional steel loop reinforcements 37 which are locally cast in concrete.

Summing up, it should be emphasized that the present invention establishes particularly economic, versatile, detachable, subsequently variable and space saving joints for the assembly construction of buildings, which joints are resistant in tension and compression, and stiff in bending.

The invention has been illustrated by way of example in the drawing, and has been described with reference thereto. However, I desire not to be limited to these examples and, therefore, the limits of the protection sought by Letters Patent are to be exclusively inferred from the language of the appended claims.

I claim:

1. A set of structural elements for assembling load-bearing structures, comprising a first structural element;

at least one second structural element; and respective cooperating abutment faces on said elements, said structural elements being adapted to be assembled relative to one another to form a load-bearing structure wherein said abutment faces extend substantially horizontally and bound with one another a gap which is horizontally elongated and which in vertical direction has a spatially curved cross-section the curvative of which extends at least in part orthogonally to the main stress lines acting upon the assembled structure in the region of said gap, so as to counter-act forces tending to move said elements apart in horizontal direction.

2. A set as defined in claim 1, wherein said abutment faces are roughened.

3. A set as defined in claim 1; and further comprising a bonding agent filling said gap and bonding said abutment faces to one another.

4. A set as defined in claim 1; and further comprising a sealing material filling said gap.

5. A set as defined in claim 4, wherein said sealing material is in form of a neoprene filler element.

6. In a method of erecting a load-bearing structure from pre-fabricated components, the steps of forming pre-fabricated components with respective elongated abutment faces which are curved transversely of their elongation; assembling respective ones of said components relative to one another to form a joint wherein juxtaposed ones of said abutment faces extend substantially horizontally and bound with one another a horizontally elongated gap having a spatially curved vertical cross-section the curvature of which extends at least in part orthogonally to the main stress lines acting upon the assembled structure in the region of said gap so as to counter-act forces tending to move said elements apart in horizontal direction.

7. A method as defined in claim 6; and further comprising the step of filling said gap with a bonding agent which bonds said abutment faces to one another.

8. A method as defined in claim 6; and further comprising the step of roughening said abutment faces to promote their bonding with said bonding agent.

9. A method as defined in claim 6; and further comprising the step of filling said gap with a sealing material.

10. A method as defined in claim 9, wherein the step of filling comprises placing a filler element of neoprene into said gap.

11. A method as defined in claim 6; and further comprising the step of roughening said abutment faces.

* * * * *